US006039485A

United States Patent [19]

Kageyama et al.

[11] Patent Number: 6,039,485

[45] Date of Patent: Mar. 21, 2000

[54] DOUBLE-CHUCK MECHANICAL PENCIL

[75] Inventors: Hidehei Kageyama; Yoshihide Mitsuya; Tadayoshi Ebinuma, all of Kawagoe, Japan

[73] Assignee: Kotobuki & Co., Ltd., Kyoto, Japan

[21] Appl. No.: 09/075,335

[22] Filed: May 11, 1998

[30] Foreign Application Priority Data

May 13, 1997 [JP] Japan ..... 9-122683
Jun. 24, 1997 [JP] Japan ..... 9-166901

[51] Int. Cl.[7] ..... B43K 21/16

[52] U.S. Cl. ..... 401/67; 401/65; 401/87; 401/94

[58] Field of Search ..... 401/67, 65, 87, 401/94

[56] References Cited

U.S. PATENT DOCUMENTS

| | | | |
|---|---|---|---|
| 2,473,149 | 6/1949 | Juelss | 401/65 |
| 2,845,898 | 8/1958 | Stanek | 401/94 |
| 3,765,781 | 10/1973 | Hashimoto et al. | 401/67 |
| 3,945,733 | 3/1976 | Edel | 401/65 X |
| 4,140,408 | 2/1979 | Mizutani | 401/65 |
| 4,571,105 | 2/1986 | Sekiguchi | 401/67 X |
| 4,729,684 | 3/1988 | Sakaoka | 401/67 X |
| 4,872,776 | 10/1989 | Kageyama et al. | 401/67 X |
| 4,976,560 | 12/1990 | Ohshita | 401/65 |
| 5,052,838 | 10/1991 | Tucker | 401/67 X |
| 5,629,363 | 5/1997 | Abber et al. | 401/215 X |

*Primary Examiner*—Henry J. Recla
*Assistant Examiner*—Kathleen J. Prunner
*Attorney, Agent, or Firm*—McGinn & Gibb, P.C.

[57] ABSTRACT

A double-chuck mechanical pencil has an outer tube, a tip fitting provided in the front of the outer tube, a tip chuck located at the tip of the tip fitting for holding a writing substance (e.g., a lead) and urged rearward in the axial directed, and a delivery chuck for delivering the lead. At least one of the tip chuck and the delivery chuck is formed of a synthetic resin material including polyoxymethylene.

26 Claims, 9 Drawing Sheets

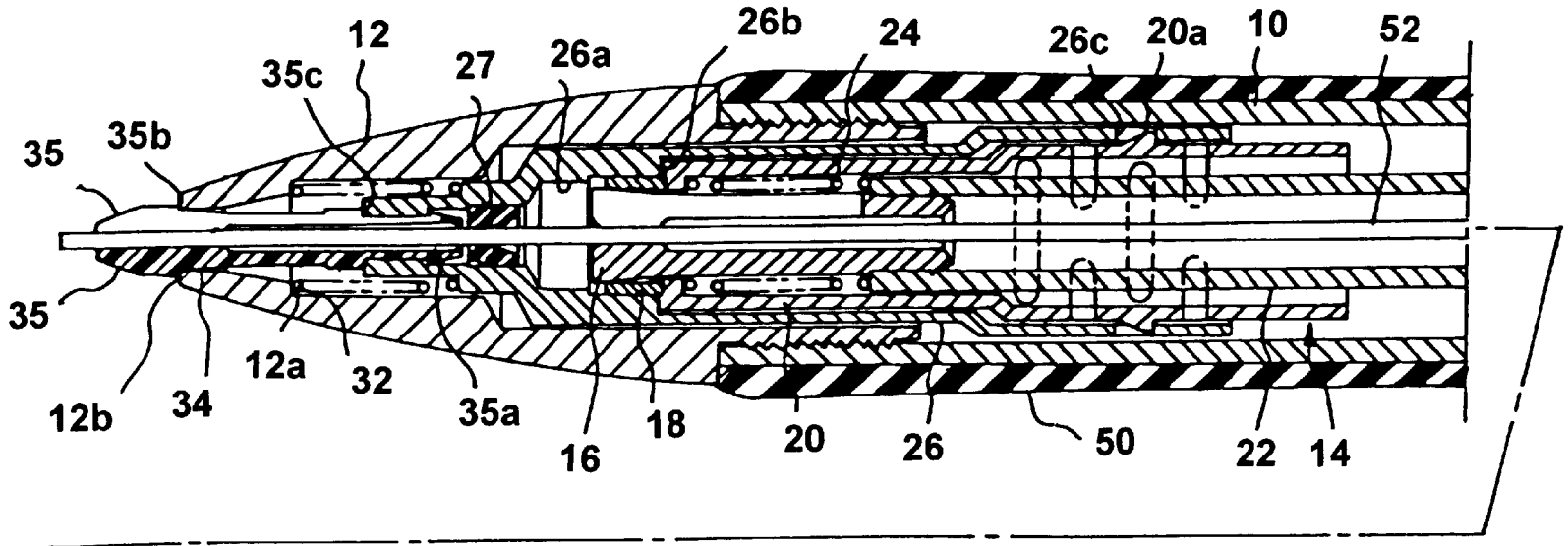
FIG.7
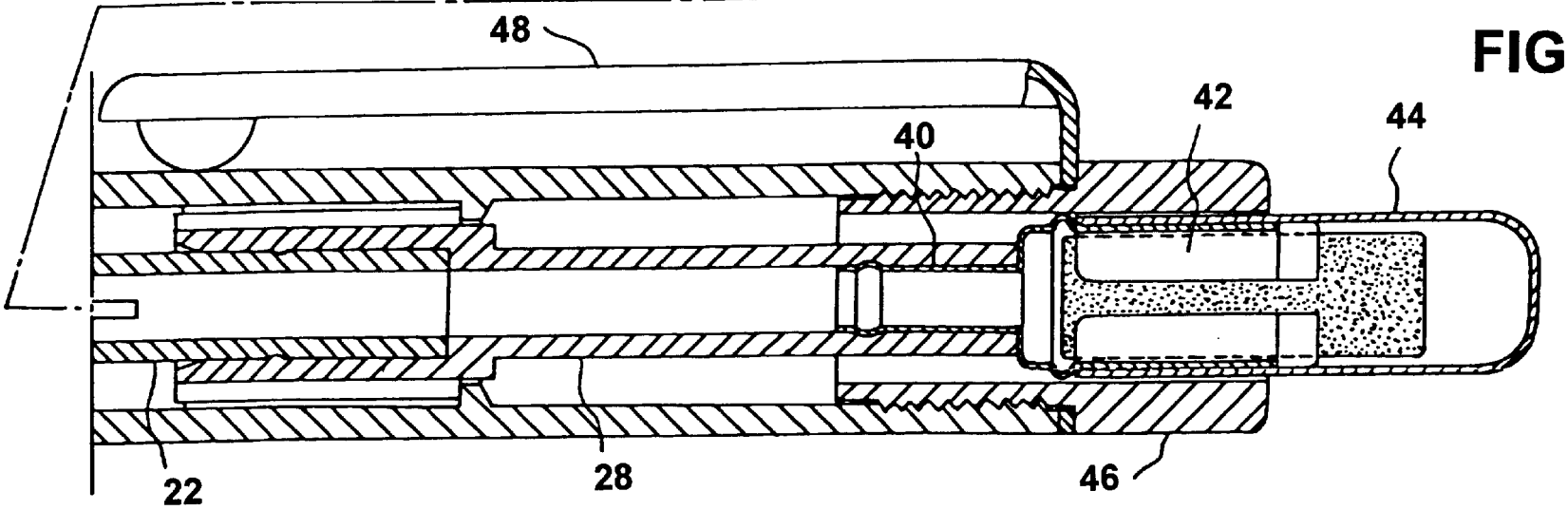

DOUBLE-CHUCK MECHANICAL PENCIL

BACKGROUND OF THE INVENTION

1. Field of the Invention

The present invention relates to a writing instrument, and more particularly to a double-chuck mechanical pencil having a tip chuck located at the tip of a tip fitting to hold a lead and a delivery chuck for delivering the lead.

2. Description of the Related Art

A conventional example of a mechanical pencil having two chucks is described in Japanese Utility Model Application Laid-Open No. 4-119435.

Generally, a tip chuck and a delivery chuck of such a mechanical pencil are formed of a metal material. To manufacture the tip and delivery chucks, an approximately cylindrical metal material must be sawed, rubbed, and cut by a cutter to divide the material into a plurality of chuck elements (e.g., two or three), which then are subjected to secondary processing such as burr removal.

Subsequently, the chuck elements of the delivery chuck must be extended outwardly, while the chuck elements of the tip chuck must be subjected to secondary processing such as narrowing because excessively-opened chuck elements cause a lead to fall (e.g., drop-out from the pencil) when the tip chuck is moved forward to release the lead. Thus, manufacturing such a mechanical pencil is labor-intensive and costly.

SUMMARY OF THE INVENTION

In view of the foregoing and other problems of the conventional writing instruments, an object of the present invention is to provide a double-chuck mechanical pencil that reduces manufacturing costs.

To achieve this and other objects, a double chuck mechanical pencil according to the present invention includes an outer tube, a tip fitting provided in the front of the outer tube, a tip chuck located at the tip of the tip fitting for holding a lead and urged rearwardly in the axial direction, and a delivery chuck for delivering a lead, the delivery chuck being movable forwardly to deliver a lead after the tip chuck has been moved forward to release the lead, wherein at least one of the tip chuck and the delivery chuck is formed of a synthetic resin material.

By forming the chucks of a synthetic resin material into a desired shape, secondary processing such as burr removal or the widening or narrowing of the tip of the chuck, or the like, is unnecessary, thereby reducing manufacturing costs.

Preferably, the synthetic resin material includes polyoxymethylene, and preferably consists essentially of polyoxymethylene. This composition provides a mechanically strong chuck with high abrasion resistance.

Additionally, preferably, the synthetic resin material includes, and preferably consists essentially of, polyoxymethylene in which glass fibers are mixed. This composition provides elastic chucks which reduce damage to leads being held by the chucks, thereby preventing the leads from being broken. Appropriate elasticity can be provided for the chucks by mixing polyoxymethylene with substantially about 5 to about 20 wt %, and preferably, substantially about 15 wt % of glass fibers.

Alternatively, the synthetic resin material includes, and preferably consists essentially of polyoxymethylene in which a lubricant is mixed. This composition enables smooth sliding between the tip fitting and the tip chuck, and between the delivery chuck and its peripheral members. Specific lubricants include molybdenum, silicon, tungsten, and/or the like.

Additionally, preferably, at least the one of the tip and delivery chucks that is formed of the synthetic resin material includes a plurality of chuck elements obtained by dividing the head of the chuck along the circumferential direction, and the circumferential gap between the adjacent chuck elements, formed when the plurality of chuck elements are allowed to approach one another such that the contour of the external shape of the chuck elements forms a true circle as seen from the axial direction, is substantially about 0.15 mm or less.

In the conventional chuck formed of a conventional metal material, an approximately cylindrical chuck is divided into a plurality of chuck elements by a cutter, so that the circumferential gap between the chuck elements cannot be reduced below the edge width of the cutter (e.g., about 0.15 to 0.2 mm). However, by forming the chucks of the synthetic resin, the chucks of the present invention can be formed into desired sizes by molding. Accordingly, the circumferential gap between the plurality of chuck elements formed when the chuck elements are allowed to approach one another such that the contour of the external shape of the chuck elements forms a true circle as seen from the axial direction, can be set to a small value (e.g., substantially about 0.15 mm or less). Consequently, the area in which the lead held by the chuck elements contacts the chuck elements can be increased to allow the leads to be reliably sandwiched by the chuck elements.

Additionally, preferably, the tip and delivery chucks include a plurality of chuck elements that are formed by dividing the chucks along the circumferential direction from a first to a second side (e.g., their head to rear side) and that are mutually separated and opposed, and the axial length of the separated and opposed chuck elements of the tip chuck is set to be shorter than that of the delivery chuck.

This configuration enables the mutual extension of the chuck elements of the tip chuck to be reduced below that of the delivery chuck. Thus, if the lead becomes short and is located in front of the delivery chuck, then the inventive mechanical pencil provides a lead holding force sufficient to prevent the chuck elements of the tip chuck from being excessively opened to prevent the lead from falling (e.g., dropping out) even when the tip chuck is releasing the lead.

Furthermore, preferably, the axial length of the holding section of the tip chuck for holding the lead inside thereof is set to be longer than that of the delivery chuck. This configuration enables the lead to be firmly sandwiched by the tip chuck, and to prevent the lead from being broken.

Additionally, preferably, a protrusion is provided at the rear end of the tip chuck, and the rear end at which the protrusion is provided, is pressed in the tip of a through-hole in an axial cylinder disposed inside the tip fitting so as to penetrate the tip of the tip fitting. A staged surface that abuts the protrusion and a larger-diameter portion that is separated from the protrusion behind the staged surface may be formed at the tip of the through-hole. The protrusion of the tip chuck engages the staged surface of the axial cylinder to prevent the tip chuck from slipping out from the axial cylinder. Additionally, since the larger-diameter portion that is separated from the protrusion of the tip chuck is formed on the axial cylinder, a radial load from the protrusion is precluded from being constantly applied to the axial cylinder, thereby to prevent the axial cylinder from being damaged.

Preferably, at least the tip chuck is formed of the synthetic resin material. This composition reduces material costs and manufacturing processes, thereby reducing manufacturing costs.

The color of the tip chuck formed of the synthetic resin material may vary depending on the diameter of the lead. This configuration enables the user to determine quickly and simply a lead diameter compatible with the mechanical pencil merely from the color of the tip chuck.

Additionally, a staged surface for abutting the tip surface of the tip fitting is provided on the tip chuck, and the rear end of the tip chuck can be coupled to the tip of a lead delivery mechanism disposed inside the tip fitting, so as to penetrate the tip of the tip fitting. When the tip fitting is disassembled from the outer tube, the staged surface of the tip chuck abuts the tip surface of the tip fitting to hinder the tip chuck and the lead delivery mechanism from slipping out from the tip fitting, thereby preventing the parts from being disconnected and lost. Since the tip chuck is formed of the synthetic resin material, the staged surface can be formed simply by molding.

Additionally, the tip chuck can be formed by combining a plurality of separate chuck members together. This configuration enables the tip chuck to be formed simply to desired sizes by molding each chuck member into a desired shape.

Additionally, the tip chuck formed of the synthetic resin material has a plurality of chuck elements that hold the lead. The plurality of chuck elements are mutually extended in the outer-diameter direction when the molding of the tip chuck is finished, and the rear ends of the chuck elements may be pressed in the tip of a central hole in the axial cylinder disposed inside the outer tube to reduce the mutual extension of the tips of the chuck elements to provide a holding force sufficient to prevent the lead from falling freely (e.g., dropping out from the pencil) when the tip chuck advances. This configuration eliminates secondary processing such as burr removal or the narrowing of the tip of the chuck to reduce manufacturing processes and costs. Even when the lead becomes shorter than the length between the tip and delivery chucks, the lead is prevented from falling because the mutual extension of the chuck elements is reduced, thereby to provide a holding force sufficient to prevent the lead from falling freely (e.g., dropping out) when the tip chuck advances to release the lead.

Additionally, optionally, a ring-like member is positioned on the outer circumferential surface of the middle of the tip chuck to limit the radial extension of the chuck elements. After the ring-like member has restricted the radial extension of each chuck element, the tip chuck can be pressed in the axial cylinder to facilitate the press-in operation. Furthermore, optionally, a protrusion that is pressed in the central hole in the axial cylinder is formed on the outer circumferential surface of the rear end of the chuck elements, and a notch for deforming the protrusion in the inner-diameter direction is formed in the side end of the chuck elements. This configuration can facilitate the operation for pressing the chuck elements in the axial cylinder.

According to another aspect of the present invention, the tip chuck formed of the synthetic resin material has a plurality of chuck elements that hold the lead. The plurality of chuck elements are mutually extended in the outer-diameter direction with respect to each other when the molding of the tip chuck is finished, and a ring-like member for hindering the radial extension of the chuck elements may be installed on the outer circumferential surface of the tip chuck to reduce the mutual extension of the tips of the chuck elements, to provide a holding force sufficient to prevent the lead from falling freely when the tip chuck advances. By forming the tip chuck of the synthetic resin material, material costs can be reduced, and the tip chuck can be molded in the desired form. This configuration also eliminates secondary processing such as burr removal or the narrowing of the tip of the chuck to reduce manufacturing processes and costs. Even when the lead becomes shorter than the length between the tip and delivery chucks, the lead is prevented from falling because the mutual extension of the chuck elements is reduced, thereby to provide a holding force sufficient to prevent the lead from falling freely when the tip chuck advances to release the lead.

Additionally, optionally, a notch for deforming the tip chuck in the inner-diameter direction is formed in the side end of the chuck elements so as to correspond to the installation of the ring-like member. This configuration facilitates the operation for installing the ring-like member on the tip chuck.

The present disclosure relates to subject matter contained in Japanese Patent Application HEI 9-122683, filed May 13, 1997 and from Japanese Patent Application HEI 9-166901, filed Jun. 24, 1997, which are expressly incorporated herein by reference in their entirety.

BRIEF DESCRIPTION OF THE DRAWINGS

The foregoing and other objects, aspects and advantages will be better understood from the following detailed description of preferred embodiments of the invention with reference to the drawings, in which:

FIG. 7 is a longitudinal sectional view showing a second embodiment of a double-chuck mechanical pencil according to the present invention;

DETAILED DESCRIPTION OF THE PREFERRED EMBODIMENTS OF THE INVENTION

Figure 1:
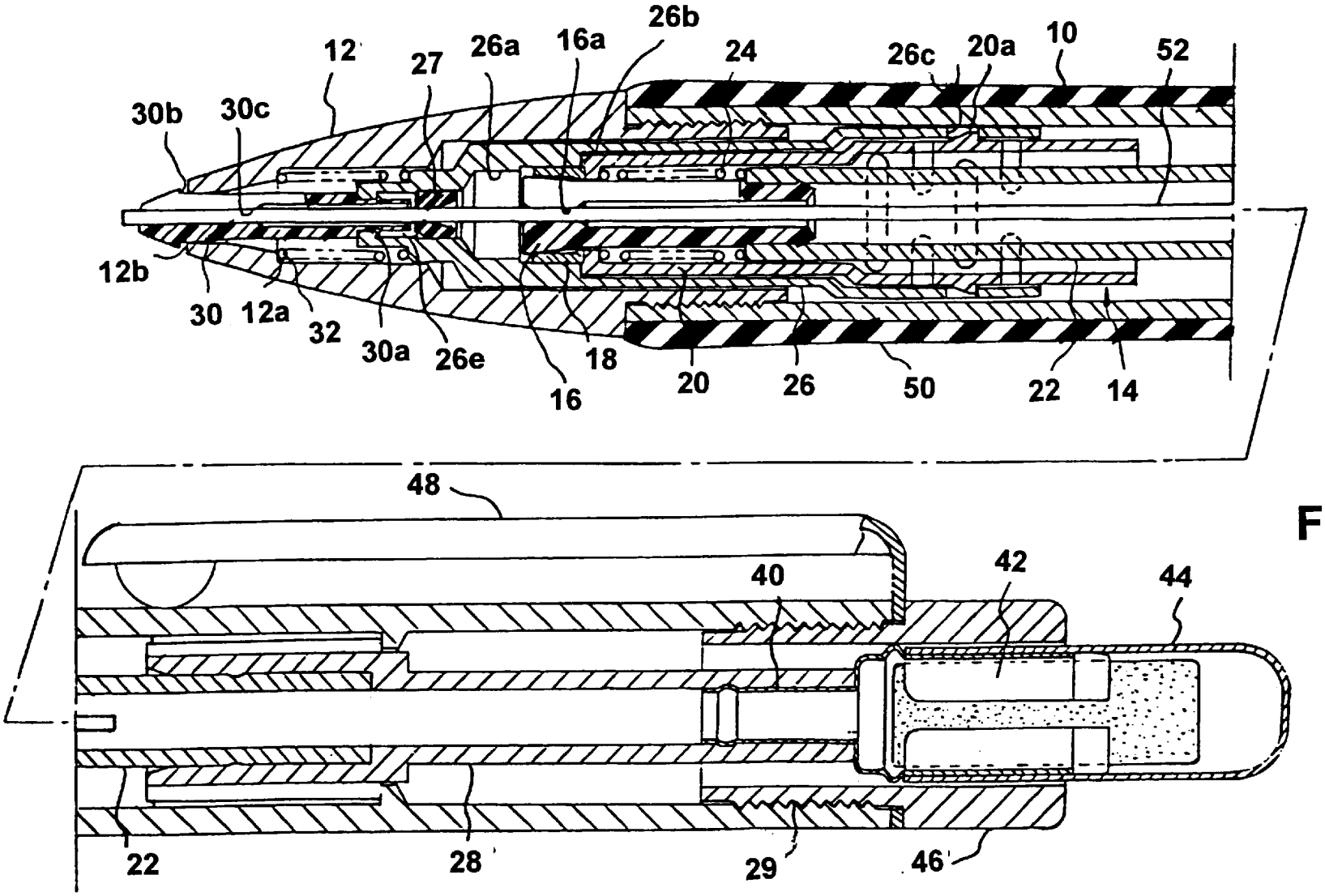
FIG. 1 is a longitudinal sectional view showing an embodiment of a double-chuck mechanical pencil according to the present invention.

Embodiments of this invention are described in detail with reference to the drawings. FIG. 1 is a longitudinal sectional view showing a first embodiment of a double-chuck mechanical pencil according to the present invention.

In FIG. 1, an outer tube 10 is shown, and a tip fitting 12 is secured by screwing or adhesion, and is provided in the front of the outer tube 10.

A lead delivery mechanism 14 is disposed inside the outer tube 10 and the tip fitting 12. The lead delivery mechanism 14 includes a delivery chuck 16 for delivering a lead, a chuck ring 18 fitted on the head of the delivery chuck 16 to tighten the delivery chuck 16, a sleeve 20 that abuts an end (e.g., the rear end) of the chuck ring 18, a lead tank (e.g., storage) 22 connected to the delivery chuck 16, a first chuck spring 24, interposed between an end (e.g., the front end) of the lead tank 22 and an end (e.g., the front end) of the sleeve 20, for urging the delivery chuck 16 rearward in an axial direction via the lead tank 22, an axial cylinder 26 into which the delivery chuck 16 and the chuck ring 18 are built, a rubber member 27 disposed in the axial cylinder 26 for holding a lead using frictional force, and a rear sleeve 28 connected to the rear end of the lead tank 22 by being press-fitted therein (e.g., a pressing-in operation).

The front end of the sleeve 20 abuts a staged (e.g., stepped) portion 26*b* provided on the inner circumferential surface of the middle of the through-hole 26*a* of the axial cylinder 26, and a protrusion 20*a* from the sleeve 20 engages an engagement hole 26*c* provided in the circumferential surface of the rear of the axial cylinder 26, for integrally connecting together the axial cylinder 26 and the sleeve 20. The axial cylinder 26 and the sleeve 20 may be integrally formed as a unitary member.

A tip chuck 30 is pressed in the tip of the through-hole 26*a* in the axial cylinder 26, so as to penetrate the tip of the tip fitting 12.

Figure 5:
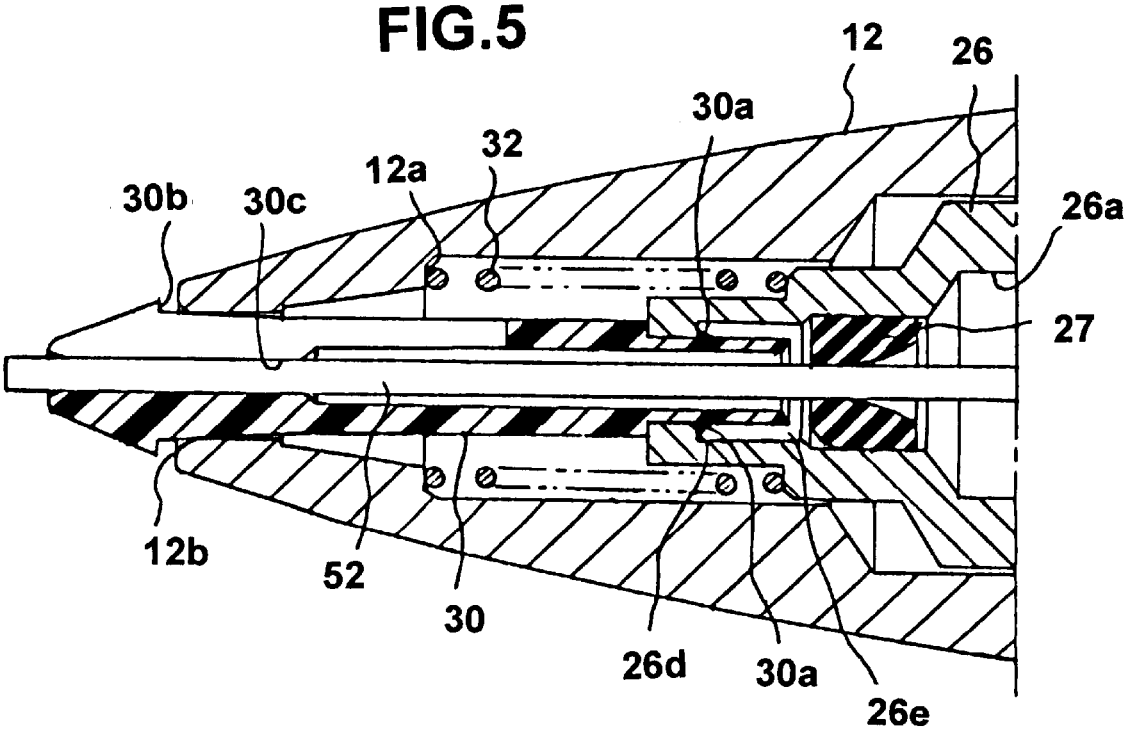
FIG. 5 is an enlarged view of a tip in FIG. 1.

Specifically, as shown in FIG. 5, a protrusion 30*a* is formed on the outer circumference of the rear of the tip chuck 30, while a staged (e.g., stepped) surface 26*d* is formed on the front of circumferential surface of the through-hole 26*a* in the axial cylinder 26. A portion of the axial cylinder 26 which is located behind the staged surface 26*d* forms a larger-diameter portion 26*e* having a larger inner diameter than a portion of the axial cylinder which is located in front of the staged surface 26*d*.

The protrusion 30*a* is pressed in the tip of the through-hole 26*a* through the tip of the axial cylinder 26, to engage the staged surface 26*d* after passing surface 26*d*, and the larger- diameter portion 26*e* forms an escape portion for the protrusion 30*a* beyond the staged surface 26*d*, to prevent the protrusion 30*a* from interfering with the larger-diameter portion 26*e* in the radial direction. This configuration prevents a radial load from protrusion 30*a* from being applied to the axial cylinder 26 to prevent the axial cylinder 26 from being damaged.

A second chuck spring 32 is interposed between the tip of the axial cylinder 26 and a staged portion 12*a* provided inside the tip fitting 12, to urge the tip chuck 30 rearwardly in the axial direction via the axial cylinder 26. The second chuck spring 32 is selected to have a smaller elastic resilient force than that of the first chuck spring 24. A staged surface 30*b* facing rearwardly is further formed on the tip chuck 30, and is pressed by the urging force of the second chuck spring 32 against a tip surface 12*b* of the tip fitting 12 that faces forward. The staged surface 30*b* interferes with (e.g., abuts) the tip surface 12*b* of the tip fitting 12, to prevent the tip chuck 30 and the lead delivery mechanism 14 from being disconnected even when the tip fitting 12 is removed from the outer tube 10.

As further shown in FIG. 1, the outer circumferential surface of a rear sleeve 28 and the inner circumferential surface of the outer tube 10 are locked using a key and a key groove 29. Furthermore, an eraser holding cylinder 40 is forcibly connected to the rear end of the rear sleeve 28, and an eraser 42 is detachably fitted in the eraser holding cylinder 40. A knock cap 44 covers the eraser, a tail closure 46 is provided, a clip 48 is sandwiched between the tail closure 46 and the rear end of the outer tube 10, and a rubber gripper 50 is wound around a gripping portion of the outer tube 10.

In the present invention, the delivery chuck 16 and the tip chuck 30 of the present invention are formed of a synthetic resin material, instead of a metal material as in the conventional mechanical pencils. A specific synthetic resin material includes, and preferably consists essentially of, polyoxymethylene (POM) that has a relatively high abrasion resistance and mechanical strength.

Additionally, by mixing substantially about 5 to about 20 wt %, and more preferably substantially about 15 wt % of glass fibers in polyoxymethylene, the elasticity can be increased to reduce damage to the lead when the lead is held by the tip chuck 30 and the delivery chuck 16.

Furthermore, the mixture of a lubricant such as molybdenum, silicon, tungsten, and/or the like can avoid abrasion caused by sliding between the tip chuck 30 and the tip fitting 12, or between the delivery chuck 16 and the chuck ring 18. Such a lubricant may be coated on metal chucks, or may be mixed in the synthetic resin material for molding, eliminating a coating operation and the like.

Additionally, the tip chuck 30 can be colored by mixing a colorant in the synthetic resin material as desired. For example, tip chucks for a 0.5 mm lead diameter are colored brown, tip chucks for a 0.3 mm lead diameter are colored yellow, and tip chucks for a 0.7 mm lead diameter are colored blue according to ISO9175-1. Such coloring is helpful for the user to quickly determine a lead diameter compatible with a particular mechanical pencil.

Figure 2A:
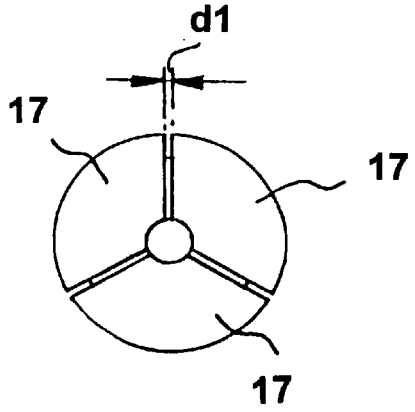
FIGS. 2(A) and 2(B) are a front view and a longitudinal sectional view, respectively, of a delivery chuck 16.
Figure 2B:
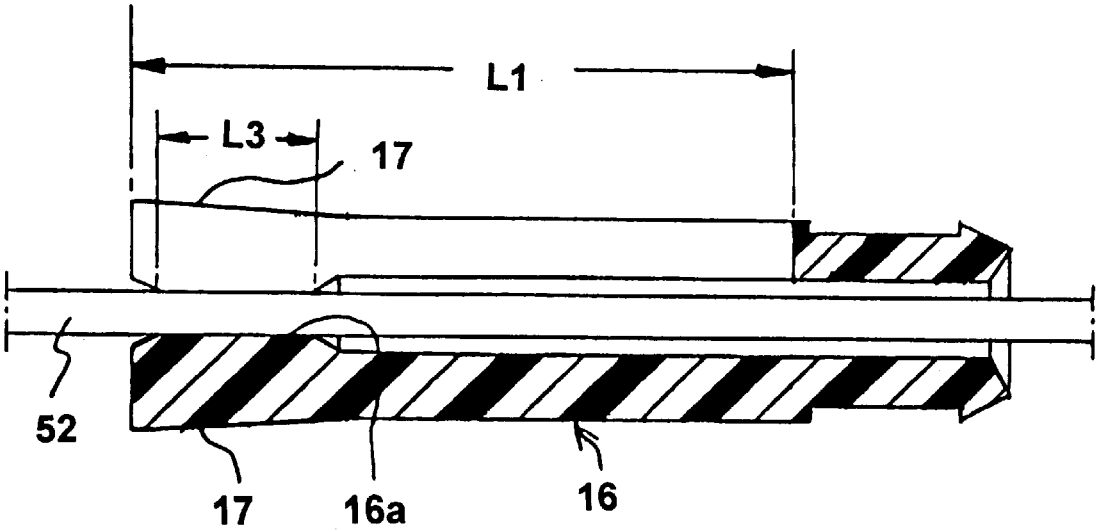

FIGS. 2(A) and 2(B) are a front view and a longitudinal sectional view, respectively, of the delivery chuck 16. FIGS. 3(*a*) and 3(*b*) are a front view and a longitudinal sectional view, respectively, of the tip chuck 30. Each of the figures shows the respective chuck 16, 30 in its closed state.

As shown, the delivery chuck 16 and the tip chuck 30 each may have a Y-shaped configuration including a plurality (e.g., three) of chuck elements 17 and a plurality (e.g., three) of chuck elements 31, respectively, that are obtained by dividing the respective chuck into three portions (e.g., chuck elements) along the circumferential direction from a first end to a second end (e.g., front to rear).

As shown in FIGS. 2(A)–(B) and 3(A)–(B), the axial length L2 of the divided chuck elements 31 of the tip chuck 30 is set to be shorter than the length L1 of the divided chuck elements 17 of the delivery chuck 16. This configuration enables the mutual extension of the chuck elements 31 of the tip chuck 30 to be reduced below the mutual extension of the divided chuck elements 17 of the delivery chuck 16. Thus, even while the tip chuck 30 is releasing a lead 52, the chuck elements 31 of the tip chuck 30 can maintain a holding force sufficient to prevent the free falling of the lead 52 without being too widely opened.

Additionally, holding sections 16*a* and 30*c* extending in parallel in the axial direction are provided inside of the delivery chuck 16 and the tip chuck 30 for holding the lead 52, respectively. The axial length M4 of the holding section 30*c* of the tip chuck 30 is set to be longer than axial length L3 of the holding section 16*a* of the delivery chuck 16. This configuration enables the tip chuck 30 to sandwich the lead 52 more firmly than the delivery chuck 16, thereby allowing the tip to hold the lead 52 firmly to prevent the lead from being broken during writing. Additionally, the sandwiching force applied to the lead by the inventive chucks 16, 30 being formed of synthetic resin material is expected to be weaker than that applied by the conventional metal chucks, and thus the lengths L3 and L4 should be set larger than when metal chucks are used.

Figure 3A:
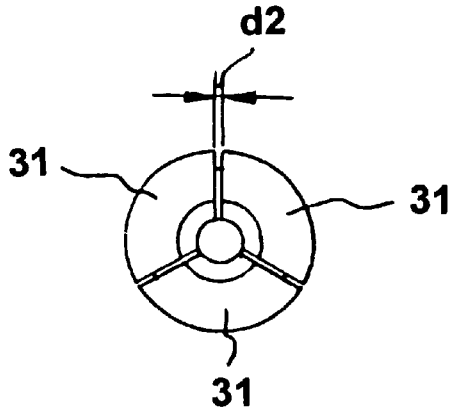
FIGS. 3(A) and 3(B) are a front view and a longitudinal sectional view, respectively, of a tip chuck 30.
Figure 3B:
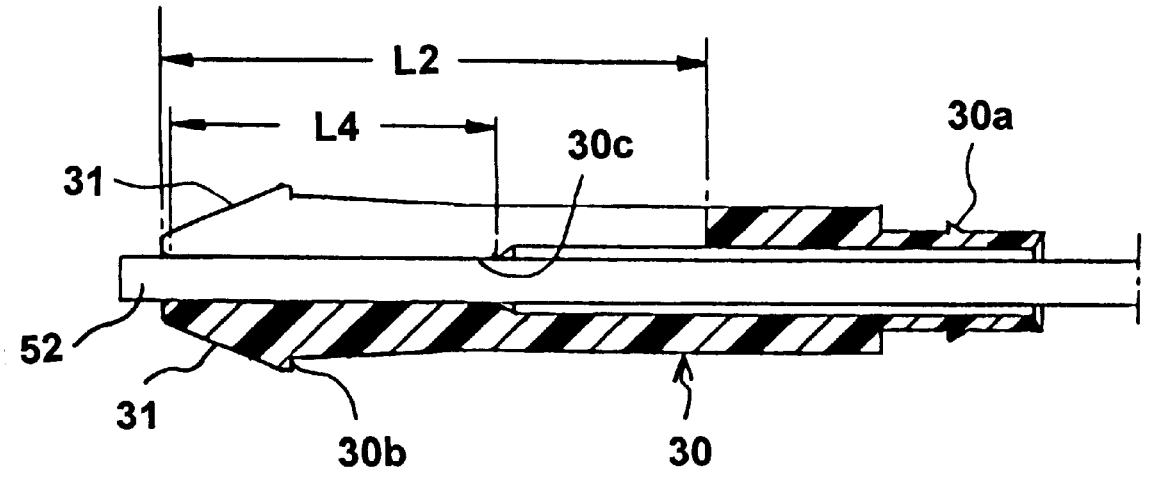

Furthermore, the gap d1 among the three adjacent chuck elements 17 of the delivery chuck 16 and the gap d2 among the three adjacent chuck elements 31 of the tip chuck 30 as shown in FIGS. 2(A) and 3(A), respectively, formed when the elements are allowed to approach one another, are set to be as close to zero as possible (e.g., substantially about 0.15 mm or less), so that the contour of the external shape of the chuck elements 17 and 31 forms a true circle as seen from the axial direction. Such a preferred gap dimension increases the area in which the lead held by the chuck elements 17 and 31 contacts the chuck elements 17 and 31, thereby allowing the lead to be reliably sandwiched by the chuck elements 17 and 31.

To mold each of the delivery chuck 16 and the tip chuck 30, the chuck elements 17 and 31 must be molded in advance so as to be opened in the radial direction with respect to each other so that they can release the lead 52.

Figure 4:
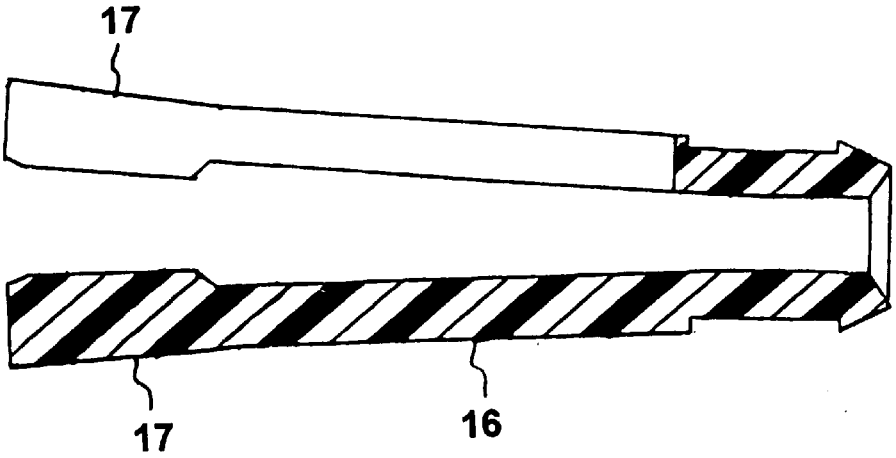
FIG. 4 is a side view showing the delivery chuck 16 in its free condition.

For example, FIG. 4 is a side view of the delivery chuck 16 in its free state, such that the chuck elements 17 are extended radially. The mutual extension of the chuck elements 17 and 31 may be adjusted taking into consideration, for example, the shrinkage factor of the resin after molding has finished and the return of the chuck elements 17 and 31 in the radially internal direction caused by a return spring force after molding. Such molding enables the chuck elements 17 and 31 to be formed so as to have appropriate mutual extensions and appropriate axial lengths so that a very small gap is formed among them when they are allowed to approach one another.

Consequently, secondary processing and the like, as in fabrication of the conventional metal chuck, are eliminated to reduce the number of required steps. Additionally, since desired shapes can be obtained by molding, the protrusion 30*a* and staged surface 30*b* of the tip chuck 30 can be formed simply.

Figure 6A:
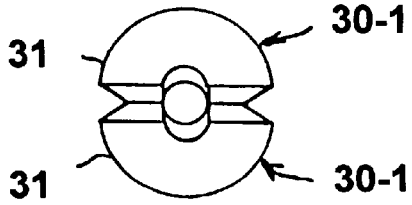
FIGS. 6(A)–6(C) illustrate another tip chuck 30, with FIG. 6(A) being a front view of the tip chuck, FIG. 6(B) being a longitudinal sectional view, respectively of the tip chuck, and FIG. 6(C) being a plan view of a chuck member forming the tip chuck.
Figure 6B:
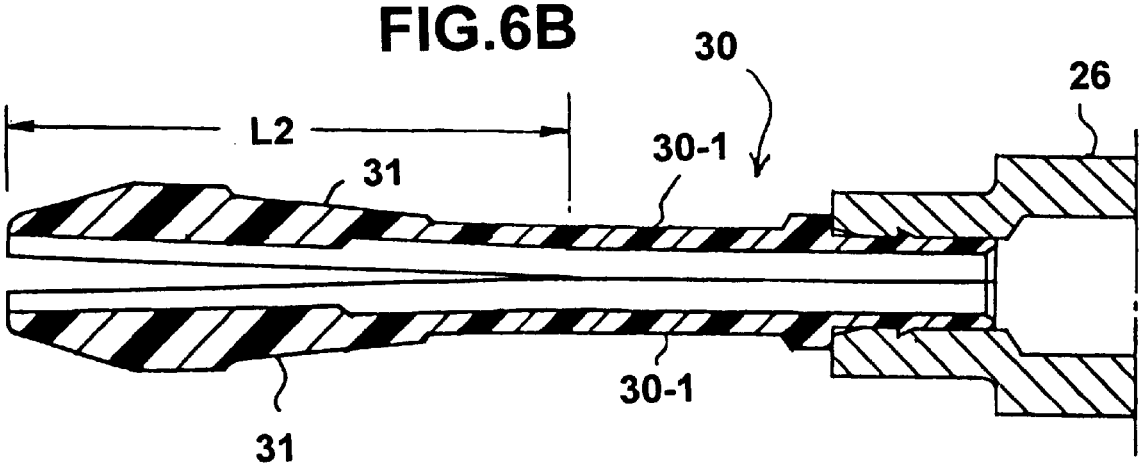
Figure 6C:
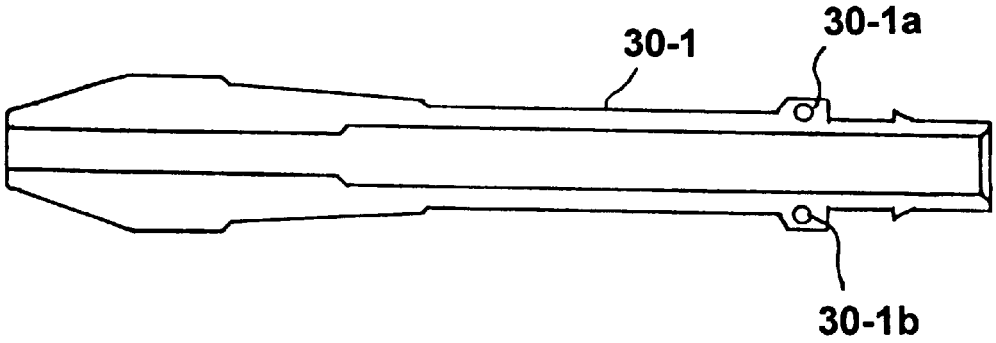

FIGS. 6(A)–6(C) show another embodiment of the tip chuck 30. The tip chuck 30 is formed by combining a plurality of (e.g., two) chuck members 30-1, 30-1 together in the vertical direction, and a protrusion 30-1*a* and a hole 30-1*b* are formed in the connecting surface of each chuck member 30-1, as shown in FIG. 6(C). The integral tip chuck 30 is formed by fitting the protrusion 30-1*a* from one of the chuck members 30-1 in the hole 30-1*b* in the other chuck member 30-1. An end (e.g., the rear end) of the chuck is integrally pressed in the axial cylinder 26. The rears of the chuck members 30-1, 30-1 are integrally connected together, whereas the tips are tilted so as to be mutually separated, thereby to form the two chuck elements 31, 31 that are divided along the circumferential direction. The axial length of the chuck elements 31, 31 is shown by L2 in FIG. 6(B).

Thus, by forming the tip chuck 30 of the plurality of chuck members 30-1, 30-1 and individually forming each chuck member 30-1 so as to have a desired shape, the length L1 and the mutual extension of the chuck elements 31 can be set to desired values. Additionally, the gap among the chuck elements 31 formed when the elements are allowed to approach each other can be set simply and easily to be as close to zero as possible, so that the contour of the external shape of the chuck elements 31, 31 forms a true circle when viewed from the axial direction.

It is noted that, while the above chucks 16, 30 have been described as each having a plurality of chuck elements (e.g., two or three chuck elements in the embodiments described), the chuck member could have more than three portions with suitable design modifications, as would be known to one of ordinary skill in the art taking the present specification as a whole.

To form the above-described pencil, the lead delivery mechanism 14 is assembled and then inserted into the tip fitting 12 via the second chuck spring 32, and the rear end of the tip chuck 30 is pressed in the axial cylinder 26 in the lead delivery mechanism 14. Then, after the tip fitting 12 has been secured to the outer tube 10, and the eraser holding cylinder 40 is pressed in the rear sleeve 28. Finally, the other parts are assembled together.

To deliver the lead 52 in the above-described double-chuck mechanical pencil, the knock cap 44 is knocked (e.g., actuated or depressed) to compress the second chuck spring 32 using the elastic resilient force smaller than that of the first chuck spring 24, thereby moving the lead delivery mechanism 14 forward. The tip chuck 30 correspondingly advances and protrudes from the tip fitting 12 to release the lead 52.

When the knock cap 44 is further actuated, the first chuck spring 24 of the lead delivery mechanism 14 is compressed to move the delivery chuck 16 forward to deliver the lead 52. Even when the lead becomes shorter than the length between the tip chuck 30 and the delivery chuck 16, actuating/depressing the knock cap 44 causes the tip chuck 30 to release the lead so as not to drop the lead. Further actuating/depressing the knock cap 44 causes the subsequent lead moved forward by the delivery chuck 16 to press and deliver the preceding lead. This operation enables even a short lead to be used for writing. When the user releases the knock cap 44, the urging force of the first and second chuck springs 24 and 32 causes the delivery and tip chucks 16 and 30 to move backward in the axial direction to sandwich the lead again. Then, the mechanical pencil is ready for writing.

Since the delivery and tip chucks 16 and 30 are formed of the synthetic resin material, although the lead 52 is sandwiched by both chucks, the elasticity of the synthetic resin material allows the lead to be held softly and prevents the lead from being damaged.

Additionally, despite the use of two chucks, material costs and manufacturing processes can be reduced, thereby to reduce manufacturing costs by forming the chucks of the synthetic resin material.

Although this embodiment has been described in conjunction with the formation of both the delivery and tip chucks of the synthetic resin material, only one of the delivery and tip chucks may be formed of the synthetic resin material. However, forming only one of the delivery and tip chucks of the synthetic resin material may be somewhat disadvantageous in terms of manufacturing costs, as compared to the above-described embodiment. Particularly, if only the delivery chuck is formed of the synthetic resin material, the amount of the return of the lead tends to be large when the chuck moves backward. Thus, if only one chuck is to be formed of the synthetic resin material, it is preferable that only the tip chuck be formed of the synthetic resin material.

Second Embodiment

FIG. 7 is a longitudinal sectional view of a second embodiment of a double-chuck mechanical pencil according to the present invention. In FIG. 7, the same elements as in FIG. 1 have the same reference numerals, and, for brevity, their detailed description is omitted.

A tip chuck 34 is pressed in the tip of the central hole 26*a* in the axial cylinder 26 so as to penetrate the tip of the tip fitting 12. A staged surface 35*b* facing rearward is formed at the tip of the tip chuck 34, and is pressed against the tip surface 12*b* of the tip fitting 12 that faces forwardly due to the urging force of the second chuck spring 32. Due to the interference (e.g., abutment) of the staged surface 35*b* with the tip surface 12*b* of the tip fitting 12, the tip chuck 34 and the lead delivery mechanism 14 are prevented from being mutually disconnected even when the tip fitting 12 is removed from the outer tube 10.

Like the tip chuck 30, the tip chuck 34 is formed of a synthetic resin material preferably including, and even more preferably consisting essentially of, polyoxymethylene (POM) having a high abrasion resistance and mechanical strength, instead of a metal material. Preferably, substantially about 5 to about 20 wt %, and even more preferably, substantially about 15 wt %, of glass fibers can be mixed in the polyoxymethylene to improve elasticity and to reduce damage to the lead when it is tightened.

Furthermore, the mixture of a lubricant such as molybdenum, silicon, and/or tungsten can avoid abrasion caused by sliding between the tip chuck 34 and the tip fitting 12. Such a lubricant is coated on metal chucks, but it can be mixed in the synthetic resin material for molding the inventive chuck, thereby eliminating a costly coating operation or the like.

Additionally, as described above the tip chuck 34 can be colored by mixing a colorant in the synthetic resin material as required. For example, tip chucks for a 0.5 mm lead diameter are colored brown, tip chucks for a 0.3 mm lead diameter is colored yellow, and tip chucks for a 0.7 mm lead diameter are colored blue according to ISO9175-1. Such coloring is helpful for the user to quickly determine a lead diameter compatible with a particular mechanical pencil.

Figure 8:
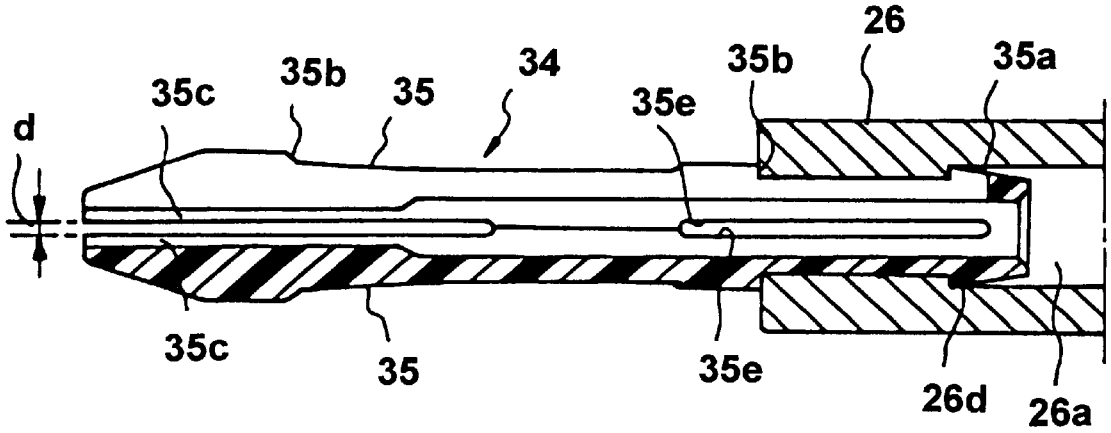
FIG. 8 is an enlarged sectional view showing a tip chuck and the front of an axial cylinder of the double-chuck mechanical pencil in FIG. 7.
Figure 9:
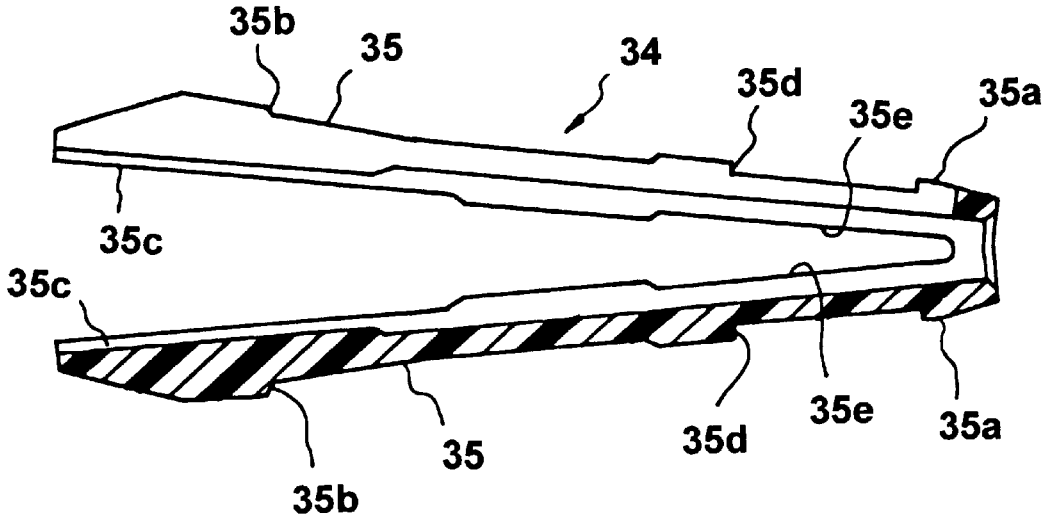
FIG. 9 is an enlarged sectional view of the tip chuck in FIG. 7 before it is pressed in the axial cylinder.

FIG. 8 is an enlarged sectional view showing the tip chuck 34 and the axial cylinder 26, and FIG. 9 is an enlarged sectional view of the tip chuck 34 before the tip chuck 34 is pressed in the axial cylinder 26. The tip chuck 34 has a Y-shape and includes a plurality of (three) chuck elements 35 that are obtained by dividing the respective chuck into three portions along the circumferential direction from a first end to a second end (e.g., head to rear), as shown in FIG. 9.

When the molding of the tip chuck 34 is finished, the chuck elements 35 of the tip chuck 34 are mutually extended in the radial direction. This configuration prevents a core pin used to mold the divided chuck elements 35 from becoming too thin. Even during a time of the tip chuck 34 releasing the lead, the chuck elements 35 of the tip chuck 34 require a holding force sufficient to prevent the free falling of the lead without being too widely opened. Thus, the rear end of the chuck elements 35 is pressed in the tip of the central hole 26*a* in the axial cylinder 26 to reduce the mutual extension of the chuck elements 35 so that their tips can provide a holding force sufficient to prevent the lead from falling freely when the tip chuck 34 advances.

Specifically, the protrusion 35*a* from the outer circumferential surface of the rear end of the chuck elements 35 is pressed in the tip of the central hole 26*a* through the tip of the axial cylinder 26, and engages the staged surface 26*d* formed in the front of the inner circumferential surface of the central hole 26*a* in the axial cylinder 26. Additionally, a staged surface 35*d* formed on the outer circumferential surface in the middle of the chuck elements 35 and facing rearward abuts the tip of the axial cylinder 26. To facilitate this press-in operation, a notch 35*e* for deforming the protrusion 35*a* in the inner-diameter direction is formed at the side end of each chuck element 35.

By adjusting the positions of the staged surfaces 35*d* and 26*d* and the protrusion 35*a*, the length of the chuck elements 35 that is inserted into the central hole 26*a* in the axial cylinder 26 is set at an appropriate value to provide the appropriate mutual extension of the chuck elements 35. Alternatively, suitable spreading of the chuck elements 35 may be provided by arraying the axial cylinder 26 to have the central hole 26*a* with a suitable diameter. As shown in FIG. 8, a circumferential gap "d" is shown between the lead holding sections 35*c* representing the mutual extension of the lead holding sections 35*c* at the tip of the chuck elements 35 when the tip chuck 34 is pressed in the axial cylinder 26. The size of the gap "d" further decreases to reliably tighten the lead when the tip chuck 34 moves backward to its rear-most position, into the tip fitting 12, as shown in FIG. 7.

In a mechanical pencil of the above configuration, the lead is delivered when the knock cap 44 is knocked (e.g., actuated) as in the first embodiment. When the lead becomes shorter than the length between the tip chuck 34 and the delivery chuck 16, actuating the knock cap 44 causes the tip chuck 34 to advance and protrude from the tip fitting 12 to release the lead. However, the lead is prevented from falling because the mutual extension of the chuck elements 35 is so small that the lead holding sections 35*c* at the tip of the chuck elements 35 provide holding force sufficient to prevent the lead from falling freely, as described above.

Further actuating the knock cap 44 causes the subsequent lead moved forward by the delivery chuck 16 to press and deliver the preceding lead held by the tip chuck 34. Hence, since the lead is simply held by the chuck elements 35 so as not to fall freely, the lead can be delivered smoothly without being damaged. When the user releases the knock cap 44, the urging force of the first and second chuck springs 24 and 32 causes the delivery and tip chucks 16 and 34 to move backward in the axial direction to sandwich the lead again. Then, even a short lead can be used for writing.

Third Embodiment

Figure 10:
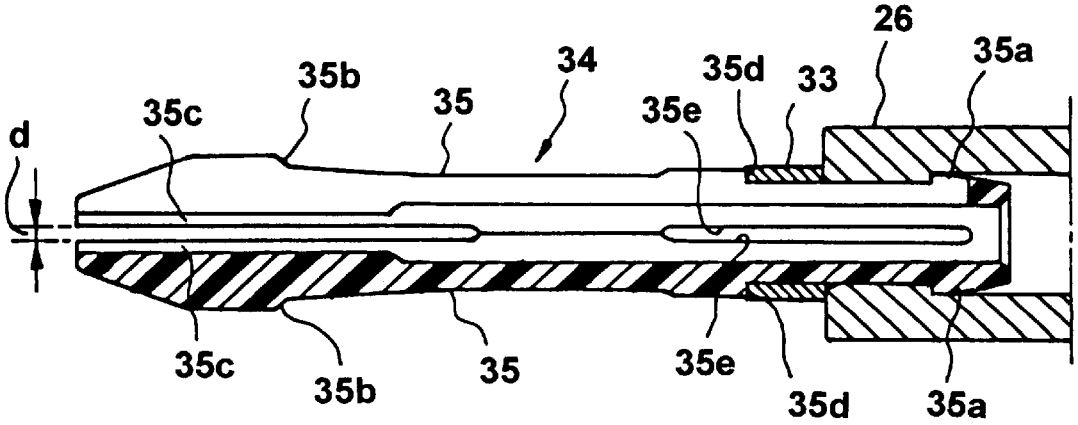
FIG. 10 corresponds to FIG. 8 and shows a third embodiment of the present invention.

FIG. 10 shows a third embodiment of the present invention, and corresponds to FIG. 8. Before pressing the tip chuck 34 in the axial cylinder 26, a ring 33 (a ring-like member) is installed on the outer circumferential surface of the tip chuck 34. That is, before pressing the tip chuck 34 into the axial cylinder 26, the ring 33 is fitted on the tip chuck 34 from its rear until it abuts the staged surface 35*d*, thereby to limit the radial extension of each chuck element 35 in the tip chuck 34. This makes the press-in operation easier.

Fourth Embodiment

Figure 11:
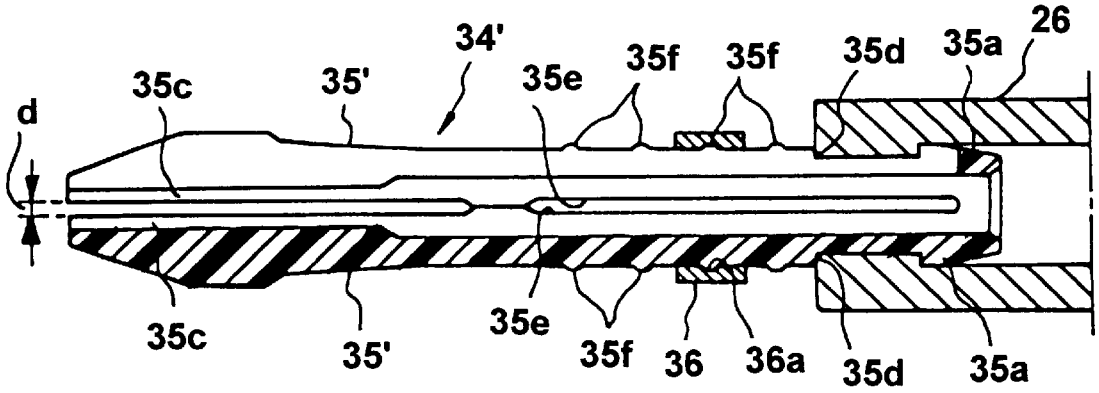
FIG. 11 corresponds to FIG. 8 and shows a fourth embodiment of the present invention.

FIG. 11 shows a fourth embodiment of the present invention, and corresponds to FIG. 8. A ring 36 (a ring-like member) is installed on the outer circumferential surface of the middle of the chuck elements 35' of a tip chuck 34', a plurality of small protrusions 35*f* are formed on the same surface in the axial direction at a specified interval, and recessed portions 36*a* for fitting on the small protrusions 35*f* are formed on the inner circumferential surface of the ring 36.

Since a notch 35*e* allows the tip chuck 34' to be deformed in the inner-diameter direction, the ring 36 can pass over the small protrusion 35*f*, and its recessed portion 36*a* can be fitted on any small protrusion 35*f* to lock the ring at any of the plurality of positions in the axial direction. The axial position of the ring 36 can be adjusted to reduce the mutual radial extension of the lead holding sections 35*c* at the tip of the chuck elements 35', to allow the lead holding sections 35*c* to provide holding force sufficient to prevent the lead from falling freely even when the tip chuck 34' advances to protrude from the tip fitting 12.

Fifth Embodiment

Figure 12:
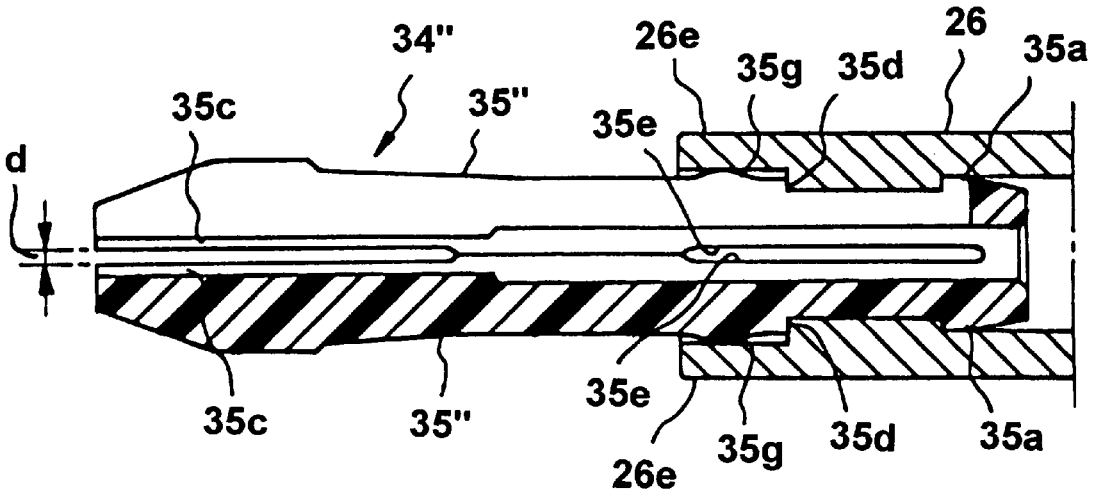
FIG. 12 corresponds to FIG. 8 and shows a fifth embodiment of the present invention.

FIG. 12 shows a fifth embodiment of the present invention, and corresponds to FIG. 8. The tip of the axial cylinder 26 is extended to form an extension 26*e*, and a protrusion 35*g* is formed on the outer circumferential surface of the middle of each chuck element 35" of a tip chuck 34" so that the extension 26*c* can press the protrusions 35*g*. This configuration reduces the mutual radial extension of the lead holding sections 35*c* at the tip of the chuck elements 35" of the tip chuck 34" to allow the lead holding sections 35*c* to provide holding force sufficient to prevent the lead from falling freely even when the tip chuck 34" advances to protrude from the tip fitting 12.

With the above-described embodiments of the present invention, an inexpensive double-chuck mechanical pencil is provided having a tip chuck located at the tip of a tip fitting for holding the lead, and a delivery chuck for delivering lead. At least one of the tip chuck and the delivery chuck is made from a synthetic resin material, thereby providing many of the advantages discussed above.

While the principles of the invention have been described above in connection with specific embodiments, and particular modifications thereof, it is to be clearly understood that this description is made only by way of example and not as a limitation on the scope of invention. Thus, while the invention has been described in terms of several preferred embodiments, those skilled in the art will recognize that the invention can be practiced with modification within the spirit and scope of the appended claims.

What is claimed is:

1. A double-chuck mechanical pencil, comprising:

an outer tube;

a tip fitting provided in a front of the outer tube, and including a tip;

a tip chuck, located at the tip of the tip fitting, for holding a lead and urged rearwardly in an axial direction; and a delivery chuck for delivering the lead, the delivery chuck being movable forwardly to deliver the lead after the tip chuck has been moved forwardly to release the lead, and wherein at least one of the tip chuck and the delivery chuck is formed of a synthetic resin material, and wherein said synthetic resin material comprises polyoxymethylene in which glass fibers are mixed.

2. A double-chuck mechanical pencil according to claim 1, wherein substantially about 5 to about 20 wt % of glass fibers are mixed with polyoxymethylene.

3. A double-chuck mechanical pencil according to claim 2, wherein substantially about 15 wt % of glass fibers are mixed with polyoxymethylene.

4. A double-chuck mechanical pencil, comprising:

an outer tube;

a tip fitting provided in a front of the outer tube, and including a tip;

a tip chuck, located at the tip of the tip fitting, for holding a lead and urged rearwardly in an axial direction; and a delivery chuck for delivering the lead, the delivery chuck being movable forwardly to deliver the lead after the tip chuck has been moved forwardly to release the lead, wherein at least one of the tip chuck and the delivery chuck is formed of a synthetic resin material, and wherein said synthetic resin material comprises polyoxymethylene in which a lubricant is mixed.

5. A double-chuck mechanical pencil, comprising:

an outer tube;

a tip fitting provided in a front of the outer tube, and including a tip;

a tip chuck, located at the tip of the tip fitting, for holding a lead and urged rearwardly in an axial direction; and a delivery chuck for delivering the lead, the delivery chuck being movable forwardly to deliver the lead after the tip chuck has been moved forwardly to release the lead, wherein at least one of the tip chuck and the delivery chuck is formed of a synthetic resin material, and wherein the at least one of the tip chuck and the delivery chuck that is formed of said synthetic resin material comprises a plurality of chuck elements obtained by dividing a head of the chuck along a circumferential direction, and wherein a circumferential gap, formed between adjacent chuck elements when the plurality of chuck elements are allowed to approach one another such that a contour of an external shape of the chuck elements forms a true circle as seen from the axial direction, is no more than substantially about 0.15 mm.

6. A double-chuck mechanical pencil, comprising:

an outer tube;

a tip fitting provided in a front of the outer tube, and including a tip;

a tip chuck, located at the tip of the tip fitting, for holding a lead and urged rearwardly in an axial direction; and a delivery chuck for delivering the lead, the delivery chuck being movable forwardly to deliver the lead after the tip chuck has been moved forwardly to release the lead, wherein at least one of the tip chuck and the delivery chuck is formed of a synthetic resin material, and wherein the tip chuck and the delivery chuck each comprise a plurality of chuck elements that are formed by dividing the tip chuck and the delivery chuck, respectively, along a circumferential direction from their head to a rear side and that are mutually separated and opposed, and wherein an axial length of the separated and opposed chuck elements of the tip chuck is shorter than that of the delivery chuck.

7. A double-chuck mechanical pencil, comprising:

an outer tube;

a tip fitting provided in a front of the outer tube, and including a tip;

a tip chuck, located at the tip of the tip fitting, for holding a lead and urged rearwardly in an axial direction; and a delivery chuck for delivering the lead, the delivery chuck being movable forwardly to deliver the lead after the tip chuck has been moved forwardly to release the lead, wherein at least one of the tip chuck and the delivery chuck is formed of a synthetic resin material, and wherein a protrusion is provided at an end of said tip chuck, and the end at which the protrusion is pressed in a tip of a through-hole in an axial cylinder disposed inside the tip fitting so as to penetrate the tip of the tip fitting, and wherein a staged surface abuts the protrusion and a larger-diameter portion is separated from the protrusion behind the staged surface are formed at the tip of the through-hole.

8. A double-chuck mechanical pencil, comprising:

an outer tube;

a tip fitting provided in a front of the outer tube, and including a tip;

a tip chuck, located at the tip of the tip fitting, for holding a lead and urged rearwardly in an axial direction; and a delivery chuck for delivering the lead, the delivery chuck being movable forwardly to deliver the lead after the tip chuck has been moved forwardly to release the lead, wherein at least one of the tip chuck and the delivery chuck is formed of a synthetic resin material, wherein at least the tip chuck is formed of the synthetic resin material, and wherein said tip chuck is colored depending on a diameter of the lead.

9. A double-chuck mechanical pencil, comprising:

an outer tube;

a tip fitting provided in a front of the outer tube, and including a tip;

a tip chuck, located at the tip of the tip fitting, for holding a lead and urged rearwardly in an axial direction; and a delivery chuck for delivering the lead, the delivery chuck being movable forwardly to deliver the lead after the tip chuck has been moved forwardly to release the lead, wherein at least one of the tip chuck and the delivery chuck is formed of a synthetic resin material, wherein at least the tip chuck is formed of the synthetic resin material, wherein a staged surface for abutting a surface of the tip of said tip fitting is provided on said tip chuck, and wherein an end of said tip chuck is coupled to a tip of a lead delivery mechanism disposed inside the tip fitting so as to penetrate the tip of the tip fitting.

10. A double-chuck mechanical pencil, comprising:

an outer tube;

a tip fitting provided in a front of the outer tube, and including a tip;

a tip chuck, located at the tip of the tip fitting, for holding a lead and urged rearwardly in an axial direction; and a delivery chuck for delivering the lead, the delivery chuck being movable forwardly to deliver the lead after the tip chuck has been moved forwardly to release the lead, wherein at least one of the tip chuck and the delivery chuck is formed of a synthetic resin material, wherein at least the tip chuck is formed of the synthetic resin material, and wherein said tip chuck is formed by combining a plurality of separate chuck members together.

11. A double-chuck mechanical pencil, comprising:

an outer tube;

a tip fitting provided in a front of the outer tube, and including a tip;

a tip chuck, located at the tip of the tip fitting, for holding a lead and urged rearwardly in an axial direction; and a delivery chuck for delivering the lead, the delivery chuck being movable forwardly to deliver the lead after the tip chuck has been moved forwardly to release the lead, wherein at least one of the tip chuck and the delivery chuck is formed of a synthetic resin material, wherein at least the tip chuck is formed of the synthetic resin material, wherein said tip chuck has a plurality of chuck elements for holding the lead, and said plurality of chuck elements are mutually extended in an outer-diameter direction when the tip chuck is molded, and wherein ends of the chuck elements are pressed in a tip of a central hole in an axial cylinder disposed inside the outer tube to reduce a mutual extension of tips of the chuck elements, to prevent the lead from falling freely when the tip chuck advances.

12. A double-chuck mechanical pencil according to claim 11, further comprising a ring member positioned on an outer circumferential surface of said tip chuck for limiting a radial extension of the chuck elements.

13. A double-chuck mechanical pencil according to claim 11, further comprising:

a protrusion that is pressed in the central hole in said axial cylinder and is formed on the outer circumferential surface of ends of said chuck elements; and a notch, formed in a side end of the chuck elements, for deforming the protrusion in an inner-diameter direction thereof.

14. A double-chuck mechanical pencil, comprising:

an outer tube;

a tip fitting provided in a front of the outer tube, and including a tip;

a tip chuck, located at the tip of the tip fitting, for holding a lead and urged rearwardly in an axial direction; and a delivery chuck for delivering the lead, the delivery chuck being movable forwardly to deliver the lead after the tip chuck has been moved forwardly to release the lead, wherein at least one of the tip chuck and the delivery chuck is formed of a synthetic resin material, wherein at least the tip chuck is formed of the synthetic resin material, wherein said tip chuck has a plurality of chuck elements for holding the lead, and said plurality of chuck elements are mutually extended in an outer-diameter direction when the tip chuck is molded, and wherein a ring member for adjusting a radial extension of the chuck elements is positioned on an outer circumferential surface of the tip chuck to reduce a mutual extension of the tips of the chuck elements to prevent the lead from falling freely when the tip chuck advances.

15. A double-chuck mechanical pencil according to claim 14, further comprising:

a notch, formed in a side end of the chuck elements, for deforming the tip chuck in an inner-diameter direction thereof so as to correspond to the positioning of said ring member.

16. A writing instrument, comprising:

a fitting including a tip;

a first chuck located at the tip of the fitting for holding a writing substance and urged in a first direction; and a second chuck for delivering the writing substance, the second chuck being movable in a second direction, to deliver the writing substance after the first chuck has been moved in the second direction to release the writing substance, wherein at least one of the first chuck and the second chuck is formed of a synthetic resin material, and wherein said synthetic resin material comprises polyoxymethylene in which glass fibers are mixed.

17. A writing instrument according to claim 16, wherein substantially about 5 to about 20 wt % of glass fibers are mixed with polyoxymethylene.

18. A writing instrument according to claim 17, wherein substantially about 15 wt % of glass fibers are mixed with polyoxymethylene.

19. A writing instrument, comprising:

a fitting including a tip;

a first chuck located at the tip of the fitting for holding a writing substance and urged in a first direction; and a second chuck for delivering the writing substance, the second chuck being movable in a second direction, to deliver the writing substance after the first chuck has been moved in the second direction to release the writing substance, wherein at least one of the first chuck and the second chuck is formed of a synthetic resin material, and wherein said synthetic resin material comprises polyoxymethylene in which a lubricant is mixed.

20. A writing instrument, comprising:

a fitting including a tip;

a first chuck located at the tip of the fitting for holding a writing substance and urged in a first direction; and a second chuck for delivering the writing substance, the second chuck being movable in a second direction, to deliver the writing substance after the first chuck has been moved in the second direction to release the writing substance, wherein at least one of the first chuck and the second chuck is formed of a synthetic resin material.

wherein the at least one of the first chuck and the second chuck that is formed of said synthetic resin material comprises a plurality of chuck elements, and wherein a circumferential gap, formed between the adjacent chuck elements when the plurality of chuck elements are allowed to approach one another, is no more than substantially about 0.15 mm.

21. A writing instrument, comprising:

a fitting including a tip;

a first chuck located at the tip of the fitting for holding a writing substance and urged in a first direction; and a second chuck for delivering the writing substance, the second chuck being movable in a second direction, to deliver the writing substance after the first chuck has been moved in the second direction to release the writing substance, wherein at least one of the first chuck and the second chuck is formed of a synthetic resin material, wherein the first chuck and the second chuck each comprise a plurality of chuck elements that are mutually separated and opposed, and wherein an axial length of the separated and opposed chuck elements of the first chuck is set to be shorter than that of the second chuck.

22. A writing instrument, comprising:

a fitting including a tip;

a first chuck located at the tip of the fitting for holding a writing substance and urged in a first direction; and a second chuck for delivering the writing substance, the second chuck being movable in a second direction, to deliver the writing substance after the first chuck has been moved in the second direction to release the writing substance, wherein at least one of the first chuck and the second chuck is formed of a synthetic resin material, and wherein said first chuck is formed by combining a plurality of separate chuck members together.

23. A writing instrument according to claim 22, further comprising a ring member positioned on an outer circumferential surface of said first chuck for limiting a radial extension of said chuck elements.

24. A writing instrument according to claim 23, further comprising:

a protrusion formed on the outer circumferential surface of an end of said chuck elements; and a notch, formed in a side end of said chuck elements, for deforming the protrusion in an inner-diameter direction thereof.

25. A writing instrument, comprising:

a fitting including a tip;

a first chuck located at the tip of the fitting for holding a writing substance and urged in a first direction; and a second chuck for delivering the writing substance, the second chuck being movable in a second direction, to deliver the writing substance after the first chuck has been moved in the second direction to release the writing substance, wherein at least one of the first chuck and the second chuck is formed of a synthetic resin material, wherein said first chuck has a plurality of chuck elements for holding the writing substance, and wherein a ring member for adjusting a radial extension of the chuck elements is positioned on an outer circumferential surface of the first chuck to reduce a mutual extension of tips of the chuck elements to prevent the writing substance from falling freely when the first chuck advances.

26. A writing instrument according to claim 25, further comprising:

a notch, formed in a side end of the chuck elements, for deforming the first chuck in an inner-diameter direction thereof so as to correspond to the positioning of said ring member.

* * * * *